US009145644B2

(12) United States Patent
Crawford

(10) Patent No.: US 9,145,644 B2
(45) Date of Patent: Sep. 29, 2015

(54) METHOD TO CONTROL RESPONSE SHAPE OF FOOTPRINT FOR ZONE MOISTURE CONTROL ON A STEAMBOX AND MAINTAIN SCREEN PLATE CLEANLINESS

(75) Inventor: Jonathan Crawford, North Vancouver (CA)

(73) Assignee: Honeywell ASCa Inc., Mississauga (CA)

( * ) Notice: Subject to any disclaimer, the term of this patent is extended or adjusted under 35 U.S.C. 154(b) by 913 days.

(21) Appl. No.: 13/362,318

(22) Filed: Jan. 31, 2012

(65) Prior Publication Data

US 2013/0192786 A1 Aug. 1, 2013

(51) Int. Cl.

| | |
|---|---|
| ***F26B 13/00*** | (2006.01) |
| ***B05B 1/14*** | (2006.01) |
| ***B05B 1/18*** | (2006.01) |
| ***D21F 7/00*** | (2006.01) |
| ***D21G 7/00*** | (2006.01) |

(52) U.S. Cl.
CPC . *D21F 7/008* (2013.01); *D21G 7/00* (2013.01)

(58) Field of Classification Search
CPC ..... D21F 7/008; D21F 7/12
USPC ..... 162/207, 308, 275, 375; 34/114, 568, 34/633, 636, 654, 639; 239/567, 565, 559, 239/548
See application file for complete search history.

(56) References Cited

U.S. PATENT DOCUMENTS

| | | | | |
|---|---|---|---|---|
| 4,249,992 | A * | 2/1981 | Wells | 162/198 |
| 4,312,139 | A * | 1/1982 | Preisler et al. | 34/571 |
| 4,981,164 | A | 1/1991 | Reichel | |
| 5,161,682 | A | 11/1992 | Seifert | |
| 6,216,398 | B1 | 4/2001 | Shipman | |
| 7,213,632 | B1 | 5/2007 | Goldstein | |
| 7,459,061 | B2 * | 12/2008 | Passiniemi | 162/272 |
| 7,871,494 | B2 | 1/2011 | Viaser | |

* cited by examiner

*Primary Examiner* — Kenneth Rinehart
*Assistant Examiner* — John McCormack
(74) *Attorney, Agent, or Firm* — Cascio Schmoyer & Zervas

(57) ABSTRACT

A steam distributor includes multiple steam discharge chambers that are separated by laterally spaced apart partition panels that create corresponding profiling zones. The profiling zones are covered by a perforated screen plate through which steam passes onto a moving sheet that is traveling in the machine direction. One or more of the partition panels is not aligned in the machine direction so that one or more of the steam discharge chambers defines a non-rectangular profiling zone. The orientation of one or more of the baffles can be adjusted in order to control the response shape of the steam footprints on a moving sheet for zone moisture control. The panels can be articulated to allow dynamic adjustments of the profiling zones for cross direction response control.

20 Claims, 5 Drawing Sheets

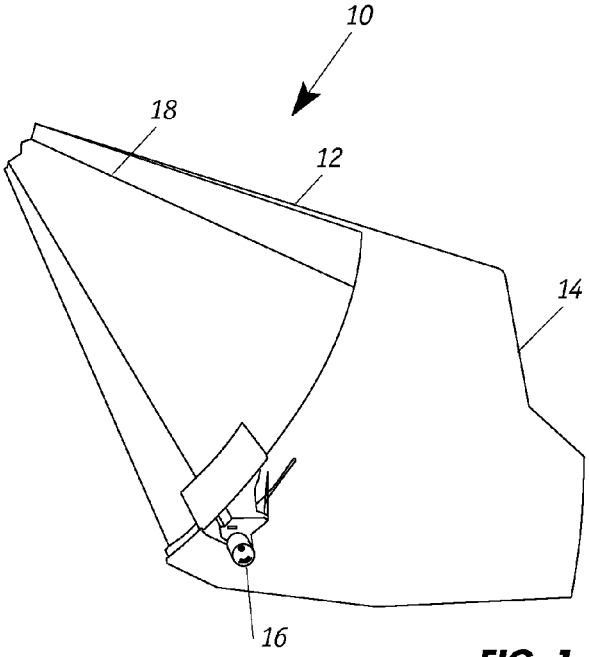
FIG. 1
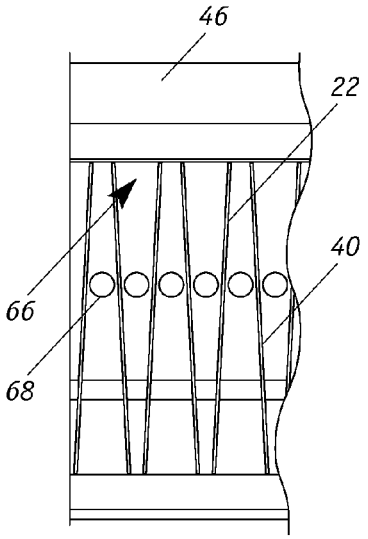
FIG. 2C
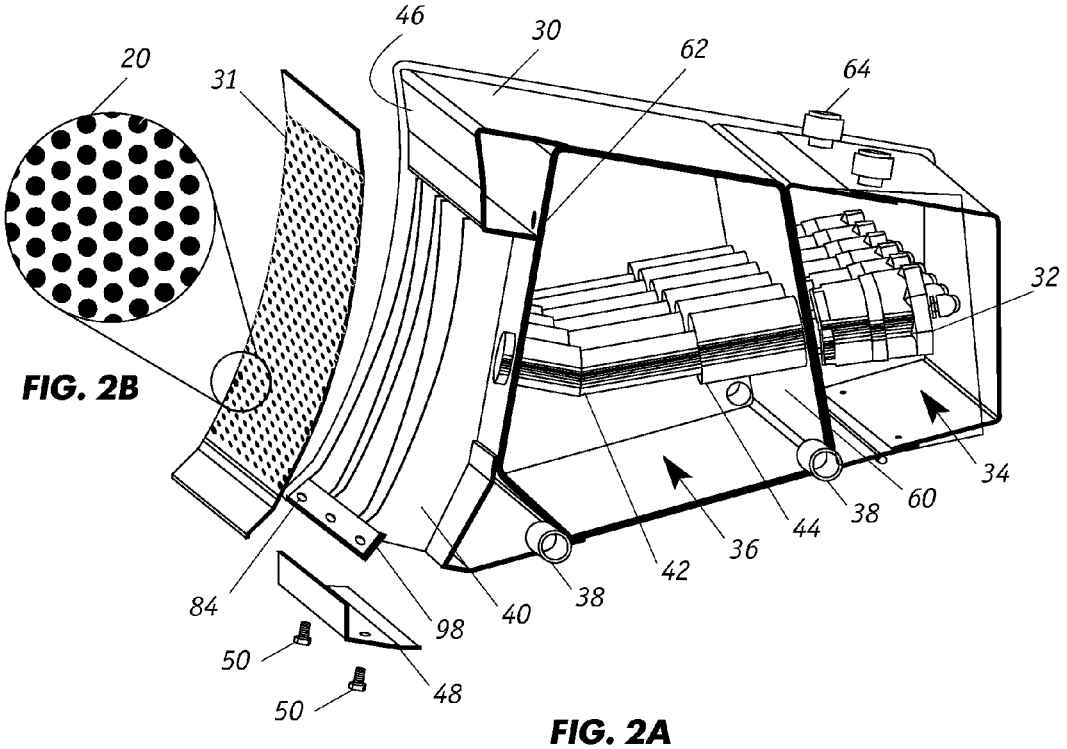
FIG. 2B
FIG. 2A

FIG. 7B
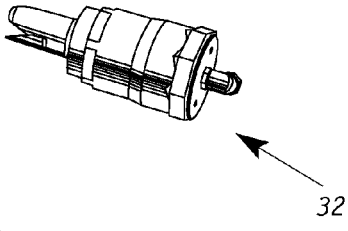
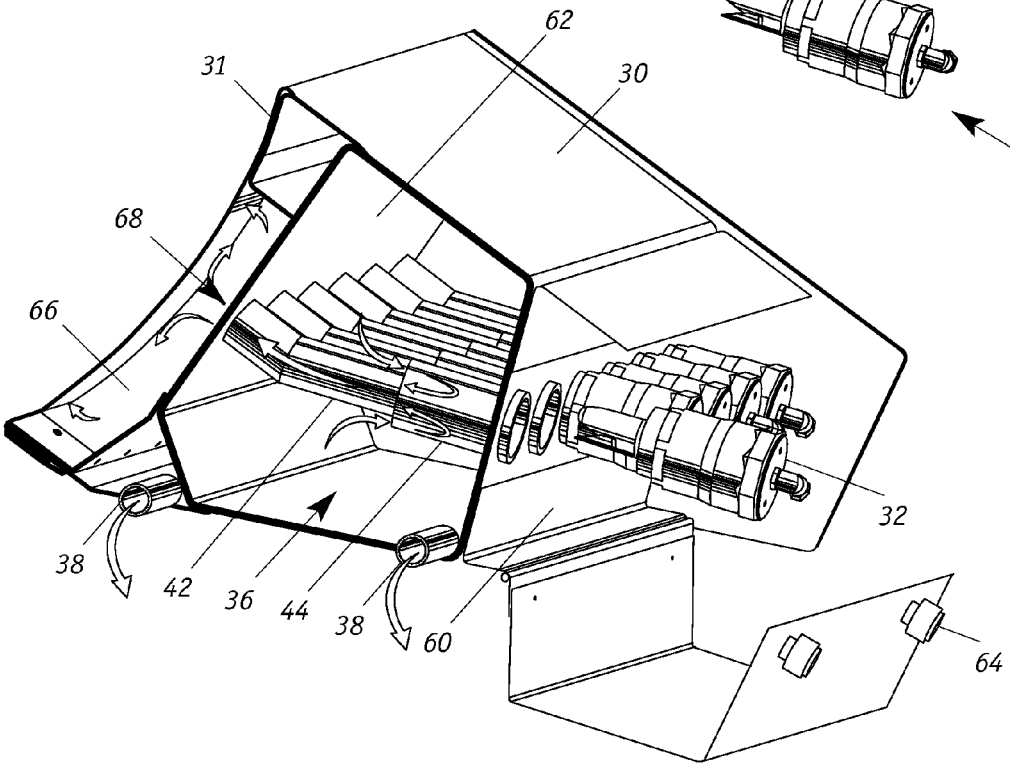
FIG. 7A

METHOD TO CONTROL RESPONSE SHAPE OF FOOTPRINT FOR ZONE MOISTURE CONTROL ON A STEAMBOX AND MAINTAIN SCREEN PLATE CLEANLINESS

FIELD OF THE INVENTION

The present invention generally relates to a steam distributor for applying steam to a paper sheet moving along its side wherein steam is discharged through a plurality of profiling zones in the steam distributor that are created by a plurality of baffles. By changing the orientation the baffles, the shapes of the profiling zones can be adjusted so that the steam output patterns, through the profiling zones and associated apertures in the screen plate, attain the required response shapes on the paper sheet.

BACKGROUND OF THE INVENTION

The steam heating of a paper sheet is widely practiced in papermaking. The increase in sheet temperature that results provides increased drainage rates for the water thus reducing the amount of water to be evaporated in the drier section. Water drainage is improved by the application of steam principally because the heating of the sheet reduces the viscosity of the water, thus increasing the ability of the water to flow. Most of the heat transfer takes place when the steam condenses in the sheet. The condensation of the steam transforms the latent heat of the steam to sensible heat in the water contained by the sheet.

A particular advantage of steam heating of the paper sheet is that the amount of steam applied may be varied across the width of the sheet along the cross machine direction so that the cross machine moisture profile of the sheet may be modified. This is usually carried out to ensure that the moisture profile at the reel is uniform. Moisture measurement devices are well known in the papermaking art that can sense the moisture profile of a sheet of paper. If such an apparatus is scanned over the paper sheet, downstream of a steam distributor, then after measuring the water profile in the sheet, steam can be applied in varying amounts on a selective basis across the sheet, thus achieving the required uniform moisture profile at the reel.

It is known to divide a steam distributor into compartments with laterally spaced-apart baffle plates that are covered with a partially perforated cover. By regulating the supply of steam into each compartment, it was possible to a limited extent to control the moisture profile of the sheet. However, the vertically oriented baffle plates and the corresponding rectangular shaped compartments do not produce footprints on the paper sheet with the required response shape for narrower zone moisture control. Furthermore, with prior art designs, fiber and dirt tend to accumulate within the compartments and over time, the debris penetrates into the internal structures and interferes with steam flow.

SUMMARY OF THE INVENTION

The present invention is based in part on the development of a steam distributor that includes multiple steam discharge chambers or compartments that are separated by partitions or baffle panels that are laterally spaced apart to create corresponding profiling zones that are covered by a perforated screen plate through which steam passes. The orientation of one or more of the baffles can be adjusted in order to control the response shape of the steam footprint on a moving sheet for zone moisture control.

Accordingly, in one aspect, the invention is directed to an apparatus to distribute steam to a moving sheet, the apparatus has a leading edge and a trailing edge relative to the sheet that is moving in a machine direction and includes:

a steam distribution header;

a housing comprising a plurality of partition panels that are positioned along the length of the apparatus to form a plurality of steam discharge chambers, with each steam discharge chamber being in fluid communication with the steam distribution header and creating a profiling zone with a defined perimeter through which steam is discharged, wherein at least one of the partition panels is not aligned in the machine direction such that at least one of the steam discharge chambers defines a non-rectangular profiling zone; and a front perforated screen plate that covers the plurality of steam discharge chambers.

In another aspect, the invention is directed to an apparatus to distribute steam to a moving sheet, the apparatus has a leading edge and a trailing edge relative to the sheet that is moving in a machine direction and includes:

a steam distribution header;

a housing comprising a plurality of partition panels that are positioned along the length of the apparatus to create a plurality of steam discharge chambers, with each steam discharge chamber being in fluid communication with the steam distribution header and forming a profiling zone with a defined outer perimeter through which steam is directed, wherein at least one of the partition panels comprises a pivotably mounted panel such that rotation of the pivotably mounted panel changes the defined outer perimeter of at least one of the profile zones; and a front perforated screen plate that covers the plurality of steam discharge chambers.

In a further aspect, the invention is directed to a method of distributing steam along a length of a continuously moving sheet in a predetermined steam distribution pattern which includes the steps of:

(a) positioning an apparatus having a leading edge and a trailing edge relative to the moving sheet, wherein the apparatus comprises:

(i) steam distribution header;

(ii) a housing comprising a plurality of partition panels that are positioned along the length of the apparatus to create a plurality of steam discharge chambers with each steam discharge chamber being in fluid communication with the steam distribution header and defining a profiling zone with a defined outer perimeter wherein at least one of the partition panels comprise an articulated panel such that movement of the articulated panel changes the defined outer perimeter of at least one of the profile zones;

(iii) actuator means for regulating the flow of steam into the plurality of steam discharge; and (iv) a front perforated screen plate that covers the plurality of steam discharge chambers;

(b) activating the actuator means to allow steam into the plurality of steam discharge chambers that passes through the defined outer perimeter of each steam discharge chamber such that the steam that is applied onto the moving sheet develops a steam distribution pattern; and (c) maneuvering at least one articulated panel to change the steam distribution pattern.

With the present invention, steam that is discharged through each of the steam discharge chambers passes through the perforated screen plate and penetrates into a sheet of advancing paper or other web substrate. The steam from each discharge chamber forms a distinct pattern or footprint as it is contacts the paper surface. The footprints corresponding to the plurality of discharge chambers can overlap with each other to form a combined, collective pattern along the width of the sheet of paper. The dimensions of each footprint depend on, among other things, (i) the dimensions of the profile zone of the discharge chamber, (ii) distribution and size of the apertures on the perforated screen plate, (iii) the velocity and volume of steam passing through the apertures; and (iv) the distance and angle of the perforated screen plate relative to the moving paper.

In a particular embodiment of the steam distribution device, one or more of the baffles (or internal dividers) is articulated so that the articulated baffle(s) can be adjusted to dynamically alter one or more profile zones during the paper manufacturing process. This allows the shapes of the responses (that is, the footprints on the paper) to be changed without changing the external perforated screen plate or shape of the steam distribution header.

BRIEF DESCRIPTION OF THE DRAWINGS

FIG. 1 is a perspective view of a steam distribution apparatus;

FIG. 2A is a perspective view of the compartments in the steam distributor apparatus;

FIG. 2B is enlarged, partial view of the front screen panel;

FIG. 2C is a partial front view of the compartments formed by stationary baffles or dividers;

FIG. 7A is another perspective view of a compartment, and

FIG. 7B illustrates an actuator.

DETAILED DESCRIPTION OF PREFERRED EMBODIMENTS

Figure 3A:
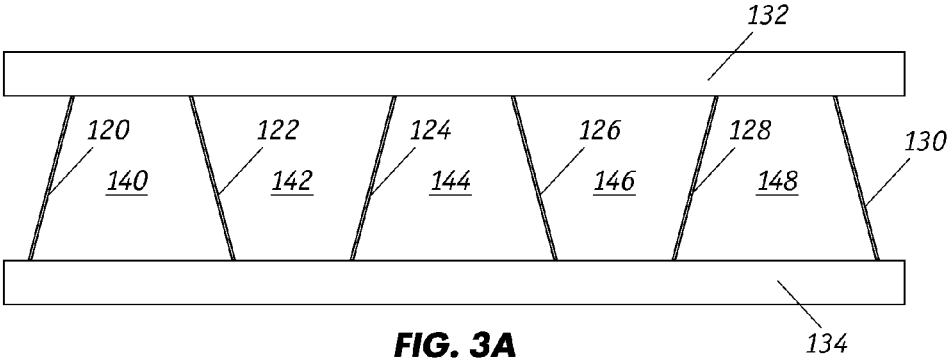
FIG. 3A is a front view of an arrangement of baffle plates in the machine direction forming trapezoidal-shaped profiling zones.

FIG. 1 illustrates the overall assembly of a steam distribution apparatus or steam box 10 which includes an elongated housing 12 that is enclosed by end plates located at opposite ends. The length of the apparatus typically corresponds to the width of the sheet or web to which steam is to be applied. For papermaking operations the length can range, for instance, up to about 30 feet (9.1 meters). An external source of steam is connected to the steam distribution apparatus 10 and excess steam in the form of condensate is removed through a drain 16 which is located on the side of end plate 14. The contour of the front screen panel or plate 18 preferably matches the external shape of the product to which steam is being supplied. The concave-shaped curvature of front screen panel 18 is particularly suited for apply steam to a roll of material. The front screen panel can also have a planar configuration to match the straight run of a moving sheet.

As further described herein, front screen panel 18 has steam outlets or perforations (not shown) that are formed thereon. The perforations are arranged so that exiting steam expands and impacts the surface of adjacent moving sheet to form a desired pattern (or response shape) of condensate, in one embodiment, the response shape is uniform along the width (or cross direction) of the moving sheet. With the present invention, the response shape can be optimized and varied.

The steam distributor apparatus 10 is separated into a plurality of steam discharge chambers or compartments along its length. By regulating the amount of steam that passes through each compartment, it is possible to control the level of condensate that is applied along the cross direction of the moving sheet. For example, the amount of steam that enters into the individual chambers can be controlled in response to variations in measured properties of the sheet along its cross direction. Furthermore, with the present invention, the perimeter(s) of one or more of the compartments that define that steam profiling zone for the steam application can also be modified. This permits control of the steam profile along the cross direction as well.

FIG. 2A shows a partially disassembled exposed portion of the housing 30 of the steam distributor apparatus. The housing 30 encloses a steam distribution header 36 which is connected to at least one source of steam (not shown). Header 36 runs the length of the steam distribution apparatus. The header 36 is flanked by an interior wall 60 and an exterior wall 62. The inner enclosure 34 shields the pneumatic actuators 32 with a removable cover that is secured by the hand tightened screws 64. A plurality of baffles or partition panels 40, that are laterally spaced apart, are secured to the exterior wall 62 thereby creating a number of steam discharge chambers or compartments once the front screen panel segment 31 is secured to the forward part of the housing.

In this embodiment, the middle of front screen segment 31 of front screen panel 18 (FIG. 1) is fully populated with outlets 20, which as shown in FIG. 2B. Outlets 20 are preferably circular but it is understood that the individual outlets can have non-circular configurations. The number and size of the outlets are designed to achieve the desired steam flow rate and velocity. The size of the outlets 20 should be sufficiently small to minimize the amount of fibers and other debris from the sheet of material being heated that enters into the discharge chambers. Nevertheless, in operation, as steam is applied through the perforations 20 onto a moving sheet of paper, for stance, the middle of from screen segment 31 can come into contact with the sheet. In this regard, it is may be preferred to avoid excessive blank areas on the middle of front screen segment since there may be a tendency for debris to accumulate in areas on the panel that are not populated with outlets. As is apparent, the number of front screen panel segments 31 required to cover a steam distribution apparatus will depend on the total cross directional length of the steam distribution apparatus and the cross directional length of each panel segment 31.

Each pneumatic actuator 32 is operatively connected to a pipe 42 which has an inlet end located, within the header 36 and an outlet end that is located in a discharge chamber. In this embodiment, the inlet end of the pipe 42 is partially covered by a sleeve 44. A piston is attached to the actuator 32 by a connecting rod to regulate the inlet into pipe 42 and thus control the steam flow between the header 36 and the control chamber.

As shown in FIG. 2C, a plurality of oblique-oriented baffles 40, which are not aligned with the machine direction of movement of the traveling sheet (not shown), form a plurality of steam discharge compartments 66 along the cross direction or width of the steam distribution apparatus 10 (FIG. 1). While baffles 40 are illustrated as being planar, it understood that they can be curved or other non-planar configuration. The perimeter(s) of discharge compartments 66 define a series of trapezoidal-shaped profiling zones 22 through which steam from outlets 68 passes as it travels toward the steam perforations 20 (FIG. 2B). In this arrangement, adjacent trapezoidal-shaped profiling zones are inverted with respect to each other.

Figure 3B:
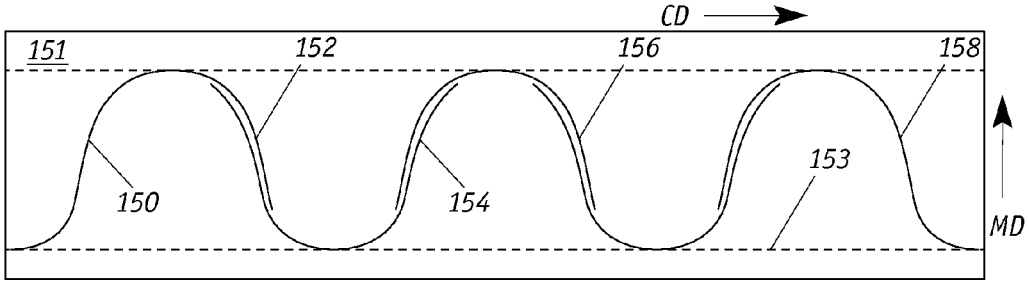
FIG. 3B is the overlapping steam response shapes generated by the trapezoidal-shaped profiling zones.

FIG. 3A depicts a laterally-spaced arrangement of alternating inverted trapezoidal-zone profiling zones 140, 142, 144, 146 and 148 that are bordered on the lateral sides by baffles 120, 122, 124, 126, 128 and 130 and on the upper and lower sides by walls 132, 134. As steam passes from each profile zone and through the steam outlets that are patterned on the from screen panel (not shown), the steam expands and forms a condensate pattern on the moving sheet. FIG. 3B illustrates a condensate pattern which is created by the profiling zone arrangement of FIG. 3A when employed in combination with a front screen panel that is folly populated with outlets (as illustrated in FIG. 2A). Specifically, the steam from profile zones 140, 142, 144, 146 and 148 develop corresponding cross-direction (CD) steam responses 150, 152, 154, 156, and 158, respectively on a sheet of paper 151 that is moving in the machine direction (MD). The individual steam responses are overlapping bell-shaped curves whose individual footprints correspond to the outer contours of the profiling zones. The individual footprints aggregate to form a narrow zone CD response shape 153. In this fashion, moisture is applied onto a moving sheet in a controlled, uniform pattern.

Figure 4A:
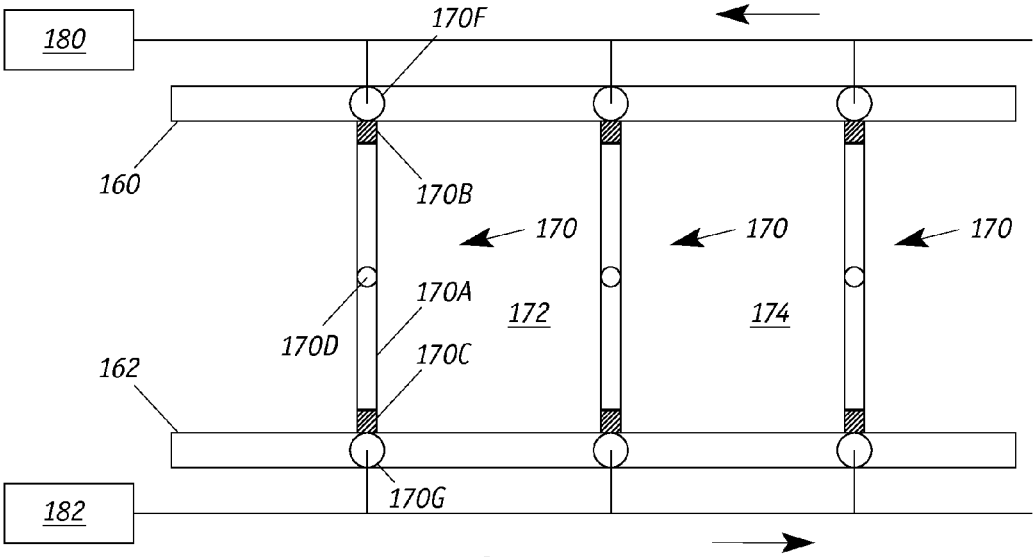
FIGS. 4A and 4B illustrate the front view of a first configuration of an articulated baffle system.
Figure 4B:
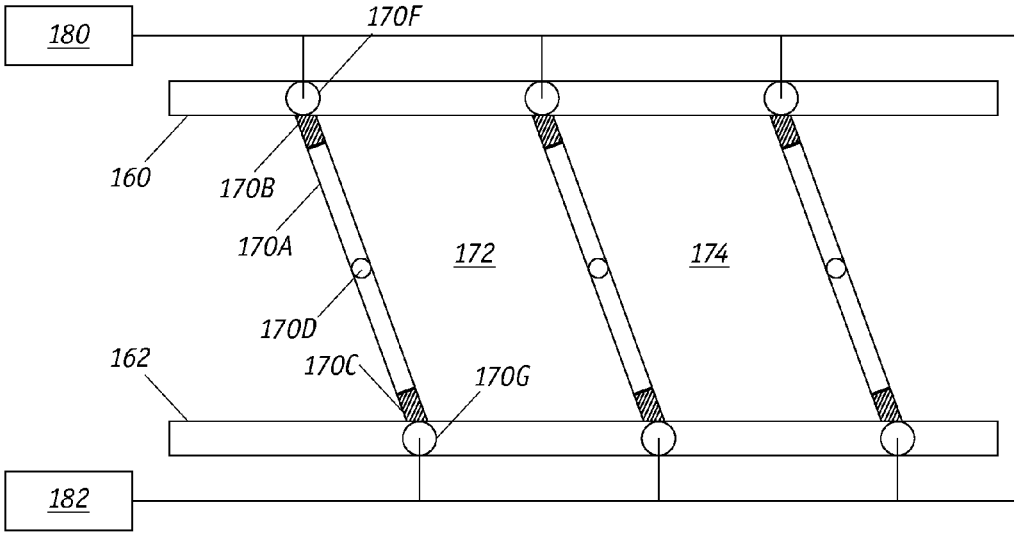

FIGS. 4A and 4B illustrate a configuration of the movable baffles or dividers that permits active adjustment of the shape of the cross direction profiling zones using articulated dividers. While only three articulated baffles 170 are shown, it is understood that multiple dividers positioned along the entire width of a steam box can be employed. Each baffle 170 includes a panel member 170A that is pivotally secured by pin 170D and has distal and proximal ends that are secured to movable guides or rollers 170F and 170G, respectively. The rollers are slidably mounted within grooves in guide rails 160 and 162, respectively. A spring mechanism or other elastic means 170B and 170C at the opposite ends of panel 170A allow rollers 170F and 170G to remain engaged to guide rails 160 and 162, respectively, even as the baffle is pivoted back and forth. The three panels are preferably spaced equidistance laterally apart so as to form two lateral steam discharge compartments 172 and 174. All three upper rollers 170F are connected to actuator 180 and all the lower rollers 170G are connected to actuator 182. The actuators can comprise motors and the like.

The two middle compartments 172,174 have rectangular shapes and therefore present rectangular profiling zones. When activated as shown in FIG. 4A, actuators 180, 182 advance the ends of the articulated baffles in opposite directions as shown in FIG. 4B. In this fashion, the shapes of the profiling zones can be dynamically adjusted even during the course of papermaking. In this case, the middle profiling zones 172,174 are transformed into rhomboids.

Figure 5A:
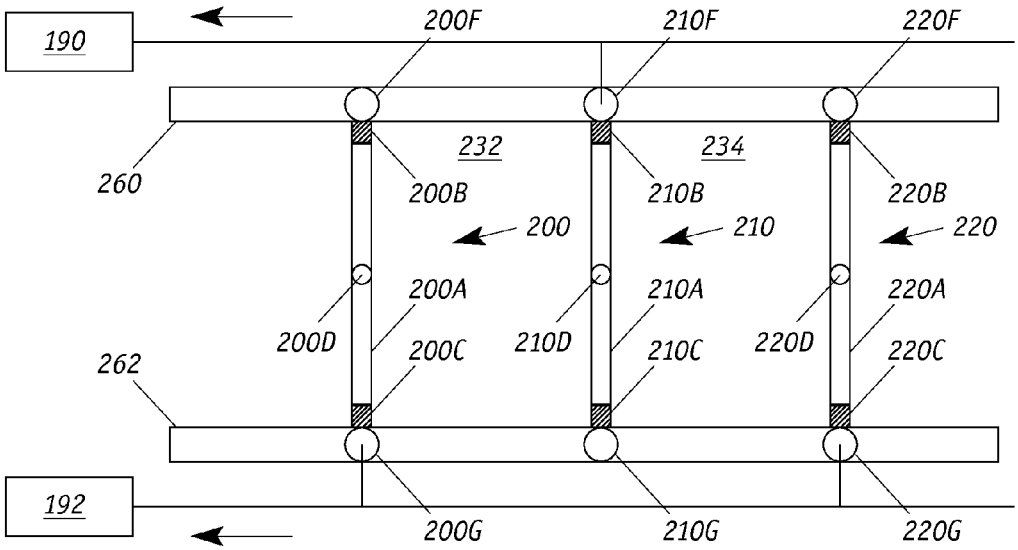
FIGS. 5A and 5B illustrate the front view a second configuration of an articulated baffle system.
Figure 5B:
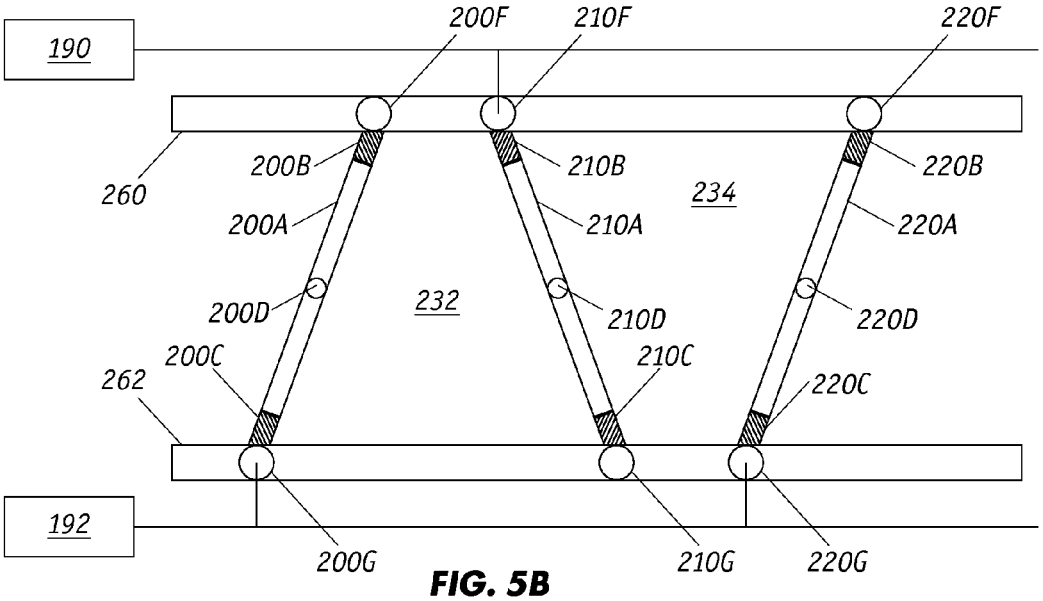

FIGS. 5A and 5B illustrate another design using articulated dividers in which the dividers do not move in unison. Baffle 200 includes a panel member 200A that is pivotally secured by pin 200D and has distal and proximal ends that are secured to rollers 200F and 200G, respectively. The rollers are mounted slidably within grooves in guide rails 260 and 262, respectively. A spring mechanism or other elastic means 200B and 200C at opposite ends of panel 200A allow rollers 200F and 200G to remain engaged to guide rails 260 and 262, respectively, even as the baffle is pivoted back and forth. Similarly, baffle 220 includes a panel member 220A that is pivotally secured by pin 220D and has distal and proximal ends that are secured to rollers 220F and 220G, respectively. Spring mechanism 220B and 220C at each end of panel 220A allow rollers 220F and 220G to remain engaged to guide rails 260 and 262, respectively. The middle baffle 210 includes a panel member 210A that is pivotally secured by pin 210D and has distal and proximal ends that are secured to rollers 210F and 210G, respectively. Spring mechanism 210B and 210C at each end of panel 210A allow rollers 210F and 210G to remain engaged to guide rails 260 and 262, respectively.

The three panels are preferably spaced equidistance laterally apart so as to form two adjacent steam discharge compartments 232,234. The lower rollers 200G and 220G of the outer baffles 200 and 220, respectively, are connected to actuator 192 but the upper rollers 200F and 220F are not connected to actuator 190. Conversely, upper roller of 210F of middle baffle 210 is connected to actuator 190 but the lower roller 210G is not connected to actuator 192. Thus when actuators 190 and 192 are activated as shown, the baffles reconfigure to the arrangement shown in FIG. 5B so as to form adjacent inverted trapezoidal steam discharge compartments 232, 234.

Figure 6:
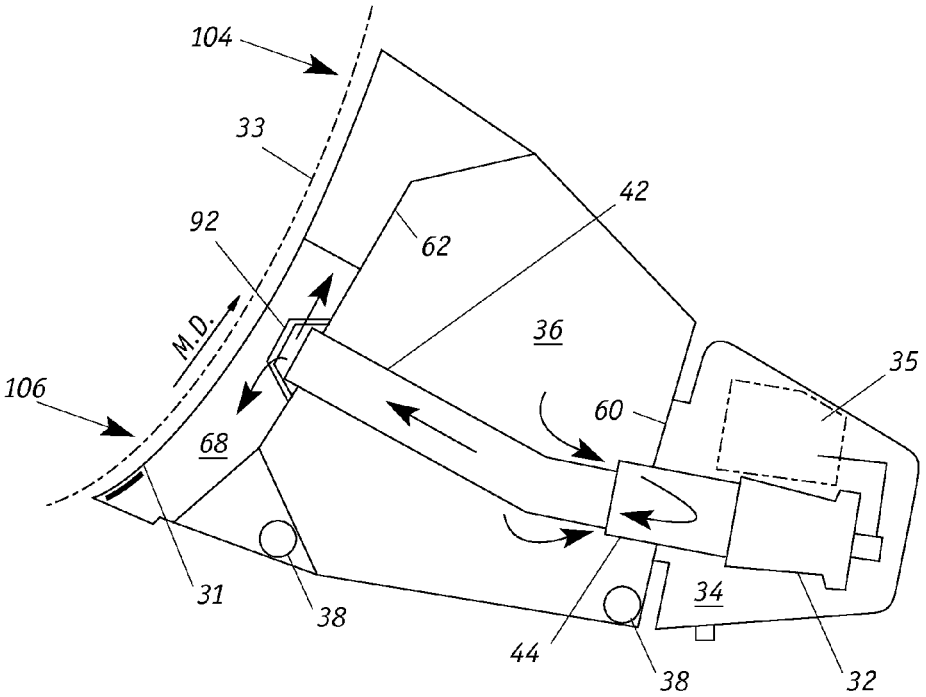
FIG. 6 is a cross sectional view of the compartment.

In operation of the steam box as shown in FIGS. 6 and 7A, high pressure steam that is supplied to the header 36 is drawn into the pipe 42 through the annular opening between the pipe 42 and the sleeve 44. The amount of steam drawn is controlled by the actuator 32 which is connected to a pneumatic supply 35 which tunes or regulates the actuator by pressurizing a diaphragm that is on top of a piston that is located inside the actuator 32. The piston is connected to a measuring plug that moves inside the sleeve 44 to control the amount of steam that goes into each discharge chamber. Steam from the pipe 42 initially enters into a discharge chamber 66 through the pipe outlet 68. The high velocity steam is dispersed within the discharge chamber 66 before exiting through the perforations of the front panel screen segment 31 and contacting a continuous moving sheet 33 located in front of the perforations. Preferably, a target plate 92 is positioned to disperse the high velocity steam uniformly throughout the discharge chamber 66 before the steam permeates through the perforations in the screen plate 31. In this fashion, there is uniform steam distribution from the leading edge 104 to the trailing edge 106 of the steam distribution apparatus as the sheet of material moves across the screen plate 31 in the machine direction. Condensate that forms on the bottom of the discharge chamber 66 seeps through a drain hole and out through a condensate drain 38.

By monitoring and controlling the steam flow into each of the discharge chambers, the steam profile that is injected onto the sheet along its cross direction can be continuously and independently regulated. The steam profile as measured along the length of the steam distribution apparatus can be uniform or non-uniform no that the sheet or web of material can be exposed to a steam curtain having different amounts of steam in the cross direction. Furthermore, in the case where the baffles are articulated, the steam profile can be dynamically adjusted during the papermaking process. These cross directional adjustments can be made in response to measurement signals generated from sensors that detect a cross direction property, such as the paper moisture profile, of the moving sheet at a location at this upstream or downstream of the steam box.

As shown in FIG. 2A, the front screen panel segment 31 has a concaved exterior contour. A backing bar 98 is secured to the lower end of the laterally spaced baffles 40. The front screen panel segment 31 can be welded onto a portion of the backing bar 98 as well as onto the baffles 40. In this fashion, the front screen panel segment 31 forms the front perforated wall of the steam discharge chambers. The front of the backing bar 98 also defines a series of dowel pins 84 that helps align the cleanout bar 48 as it is secured with screws 50 to the body of the steam distribution apparatus. When it is necessary to clean the steam discharge chambers between the baffles 40, it is only necessary to remove the cleaning bar 48 to gain access to the discharge chambers through access slots that are located at the lower end of each discharge chamber.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An apparatus to distribute steam to a moving sheet, the apparatus having a leading edge and a trailing edge relative to the sheet that is moving in a machine direction (MD), the apparatus comprising:

a steam distribution header;

a housing comprising a plurality of oblique-oriented partition panels that are positioned along the length of the housing to form a plurality of steam discharge chambers that are positioned along the length of the housing which is parallel to the cross direction (CD), wherein the CD is perpendicular to the MD, such as that each oblique-oriented partition panel separates adjacent steam discharge chambers and the plurality of oblique-oriented partition panels are not aligned in the MD, with each steam discharge chamber being in fluid communication with the steam distribution header and creating a non-rectangular profiling zone with a defined perimeter through which steam is discharged; and a front perforated screen plate that covers the plurality of steam discharge chambers.

2. The apparatus of claim 1 where adjacent profiling zones have substantially the same area through which steam is directed.

3. The apparatus of claim 1 wherein the plurality of oblique-oriented partition panels form a plurality of steam discharge chambers each with a trapezoidal-shaped profiling zone wherein adjacent trapezoidal-shaped profiling zones are inverted with respect to each other.

4. The apparatus of claim 1 wherein the front perforated screen plate comprises a plurality of steam outlets that are distributed over the front perforated screen plate and which are configured and arranged to avoid debris build up on the perforated screen plate.

5. The apparatus of claim 1 comprising articulated panels that are rotatable to change the shape of each profiling zone.

6. The apparatus of claim 1 wherein each steam discharge chamber is connected to the steam distribution header by a conduit that has an inlet located in the steam distribution header and an outlet located in the steam discharge chamber.

7. The apparatus of claim 1 wherein the front perforated screen plate has an exterior surface with a contour that is planar or that matches that of the moving sheet.

8. An apparatus to distribute steam to a moving sheet, the apparatus having a leading edge and a trailing edge relative to the sheet that is moving in a machine direction (MD), the apparatus comprising:

a steam distribution header;

a housing comprising a plurality of pivotably mounted partition panels that are positioned along the length of the housing which is parallel to the cross direction (CD), wherein the CD is perpendicular to the MD, to create a plurality of steam discharge chambers that are positioned along the length of the housing such that the pivotably mounted partition panel separates adjacent steam discharge chambers with each steam discharge chamber being in fluid communication with the steam distribution header and forming a profiling zone with a defined outer perimeter through which steam is directed, wherein rotation of the plurality of pivotably mounted partition panel changes the defined outer perimeter of each profile zones to form a plurality of non-rectangular profiling zones with oblique-oriented pivotably mounted partition panels that are not aligned with the MD; and a from perforated screen plate that covers the plurality of steam discharge chambers.

9. The apparatus of claim 8 wherein the plurality of oblique-oriented pivotably partition panels form a plurality of steam discharge chambers each with (i) a trapezoidal-shaped profiling zone wherein adjacent trapezoidal-shaped profiling zones are inverted with respect to each other or (ii) a rhomboid-shaped profiling zone.

10. The apparatus of claim 8 comprising a rotation mechanism to which each pivotally mounted partition panel is secured.

11. The apparatus of claim 10 wherein the rotation mechanism comprises a first movable guide and a second movable guide and wherein each pivotably mounted partition panel comprises a proximal end is engaged to the first movable guide and a distal end that is engaged to the second movable guide.

12. The apparatus of claim 8 further comprising a rotation mechanism to which the plurality of pivotally mounted partition panels are engaged whereby maneuvering the plurality of pivotally mounted partition panels define an alternating arrangement of rotatable panels.

13. A method of distributing steam along a length of a continuously moving sheet in a predetermined steam distribution pattern which comprises the steps of:

(a) positioning an apparatus having a leading edge and a trailing edge relative to the moving sheet that is traveling in the machine direction (MD), wherein the apparatus comprises:

(i) steam distribution header;

(ii) a housing comprising a plurality of articulated partition panels that are positioned along the length of the housing which is parallel to a cross direction (CD), wherein the CD is perpendicular to the MD to create a plurality of steam discharge chambers that are positioned along the length of the housing such that each articulated partition panel separates adjacent steam discharge chambers with each steam discharge chamber being in fluid communication with the steam distribution header and defining a profiling zone with a defined outer perimeter wherein movement of the plurality of articulated partition panel changes the defined outer perimeter of each profile zone;

(iii) actuator means for regulating the flow of steam into the plurality of steam discharge chambers; and (iv) a front perforated screen plate that covers the plurality of steam discharge chambers;

(b) activating the actuator means to allow steam into the plurality of steam discharge chambers that passes through the defined outer perimeter of each steam discharge chamber; and (c) maneuvering the plurality of articulated partition panels whereby the plurality of articulated partition panels are obliquely oriented and are not aligned to the MD such that steam exiting each steam discharge chamber forms a condensate pattern on the moving sheet that overlaps adjacent condensate patterns distribution pattern is formed along a width of the moving sheet.

14. The method of claim 13 wherein the flow of steam into each of the plurality of steam discharge chambers is independently regulated.

15. The method of claim 13 wherein the moving sheet comprises paper.

16. The method of claim 13 wherein steam is distributed uniformly along the cross direction of the moving sheet.

17. The method of claim 13 comprising the step of measuring a cross direction property profile of the moving sheet at a location upstream or downstream of the steam box and maneuvering the plurality of the articulated partition panels to change the collective steam distribution pattern along the cross direction.

18. The method of claim 13 wherein the plurality of obliquely oriented articulated partition panels form a plurality of steam discharge chambers each with (i) a trapezoidal-shaped profiling zone wherein adjacent trapezoidal-shaped profiling zones are inverted with respect to each other or (ii) a rhomboid-shaped profiling zone.

19. The method of claim 13 wherein the apparatus comprises a rotation mechanism to which each articulated partition panel is secured.

20. The apparatus of claim 19 wherein the rotation mechanism comprises a first movable guide and a second movable guide and wherein each articulated partition panel comprises a proximal end is engaged to the first movable guide and a distal end that is engaged to the second movable guide.

* * * * *